United States Patent [19]

Thompson

[11] Patent Number: 4,931,131

[45] Date of Patent: Jun. 5, 1990

[54] PACKAGE COLLATOR MACHINE

[76] Inventor: Ralph F. Thompson, 5997 Woodridge Dr., Milford, Ohio 45150

[21] Appl. No.: 360,993

[22] Filed: Jun. 2, 1989

[51] Int. Cl.[5] ..... B65B 9/12; A21C 15/00

[52] U.S. Cl. ..... 156/556; 53/540; 156/558; 156/563; 198/418.4

[58] Field of Search ..... 156/556–558, 156/300–302, 563; 198/422, 418.2–418.4; 53/540, 543; 99/450.4

[56] References Cited

U.S. PATENT DOCUMENTS

| | | | |
|---|---|---|---|
| 3,238,695 | 3/1966 | Dugle et al. . | |
| 3,250,372 | 5/1966 | Wagner et al. . | |
| 3,251,172 | 5/1966 | Dugle et al. . | |
| 3,343,504 | 9/1967 | Beik | 99/450.4 |
| 3,391,777 | 7/1968 | Joa | 198/418.4 |
| 3,479,792 | 11/1969 | Jensen et al. | 53/540 X |
| 4,081,943 | 4/1978 | Leasure et al. | 156/556 X |
| 4,114,524 | 9/1978 | Welch | 198/418.4 |
| 4,307,800 | 12/1981 | Joa | 198/374 |
| 4,450,949 | 5/1984 | Buschor et al. | 198/418.4 |
| 4,566,926 | 1/1986 | Stumpf | 156/558 |
| 4,733,518 | 3/1988 | Griesdorn . | |

*Primary Examiner*—David Simmons
*Attorney, Agent, or Firm*—Wood, Herron & Evans

[57] ABSTRACT

A package collator machine adapted to translate two successive in-line packages into face-to-face paired orientation, particularly where the faces of those packages present plural curved surfaces, e.g., shrink wrapped sausages. The machine includes first and second package conveyors, one having a transfer section of a lesser length and the other having a transfer section of a greater length, that are juxtaposed to define common entry and exit points. The difference between the lesser and greater conveyor lengths is at least equal to the length of the trailing package of each package pair. A series of active package seats is preferably connected with one of the first and second conveyors, and a series of inactive package seats is connected with the other of those conveyors. The active package seats are connected with a vacuum system that holds packages in place while the packages are moved between entry and exit points when the active seat conveyor is oriented above the inactive seat conveyor during use of the machine. The first and second package conveyors preferably are operated at the same line speeds as packages move through their transverse sections between entry and exit points. Accordingly, two in-line packages at the conveyors' entry point are re-oriented into face-to-face paired orientation at the conveyors' exit point because of the difference in conveyor length and the sameness of the conveyor line speed.

28 Claims, 7 Drawing Sheets

PACKAGE COLLATOR MACHINE

This invention relates to packaging machinery. More particularly, this invention relates to packaging machinery adapted to collate an infeed of successive in-line individual packages into an outfeed of successive pairs of individual packages.

There are many steps in the manufacture and distribution of sausages, e.g., hotdogs to the retail consumer. One area in which significant handling problems arise is in the packaging of hotdogs by the meat processor. One common packaging system currently in use involves the heat shrink wrapping of hotdogs in individual packages of, e.g., four or six hotdogs. In each package the hotdogs are oriented side by side with their longitudinal axes parallel one to the other, and that hotdog group then encased in a shrinkable wrap. This results in a hotdog package with curved upper and lower surfaces because the shrinkable wrap tends to conform to the cross-sectional configuration of the hotdogs.

It is common in the marketing of hotdogs that two such shrink wrapped hotdog packages be banded together so as to create a final package of, e.g., eight or twelve hotdogs. In this approach, two shrink wrapped hotdog packages are brought together in face-to-face orientation so that a band can be wrapped therearound. From a practical commercial standpoint, and in the packaging of hotdogs in this fashion, it is desirable to provide packaging machinery by which individual shrink wrapped hotdog packages are translated into paired face-to-face orientation from an infeed in-line orientation while being moved in conveyor fashion in order that same can be subsequently banded together in that paired configuration. With hotdog packages of the type described above, this is difficult because of the curved or wavy nature of the packages' primary surfaces.

Accordingly, it has been one objective of this invention to provide a package collator machine in which plural packages are translated from in-line individualized orientation into face-to-face paired orientation, particularly where those packages have curved or otherwise irregular primary faces.

It has been another objective of this invention to provide a package collator machine adapted to translate successive packages from in-line individualized orientation into face-to-face paired orientation where one package of each pair cooperates with a vacuum active package seat and the other cooperates with an inactive package seat, the vacuum active seats being attached to a first conveyor oriented above a second conveyor to which the inactive package seats are attached.

It has been another objective of this invention to provide a package collator machine adapted to translate a series of packages from in-line individualized orientation into face-to-face paired orientation which makes use of first and second package conveyors, one of those conveyors having a transfer section of a lesser conveyor length and the other conveyor having a transfer section of a greater conveyor length, both of the conveyors being operable at the same line speed to move plural packages through the transfer sections, the difference between lesser and greater conveyor lengths being at least equal to the package of the trailing package so that the leading and trailing packages of each package pair are translated from the in-line to face-to-face orientation.

In accord with these objectives, the package collator machine of this invention is adapted to translate two successive in-line packages into face-to-face paired orientation, particularly where the faces of those packages present plural curved surfaces, e.g., shrink wrapped sausages. The machine includes first and second package conveyors, one having a transfer section of a lesser length and the other having a transfer section of a greater length, that are juxtaposed to define common entry and exit points. The difference between the lesser and greater conveyor lengths is at least equal to the length of the trailing package of each package pair. A series of active package seats is preferably connected with one of the first and second conveyors, and a series of inactive package seats is connected with the other of those conveyors. The active package seats are connected with a vacuum system that holds packages in place while the packages are moved between entry and exit points when the active seat conveyor is oriented above the inactive seat conveyor during use of the machine. The first and second package conveyors preferably are operated at the same line speeds as packages move through their transverse sections between entry and exit points. Accordingly, two in-line packages at the conveyors' entry point are re-oriented into face-to-face paired orientation at the conveyors' exit point because of the difference in conveyor length and sameness of conveyor line speed.

Other objectives and advantages of this invention will be more apparent from the following detailed description taken in conjunction with the drawings in which.

GENERAL DESCRIPTION

Figure 1:
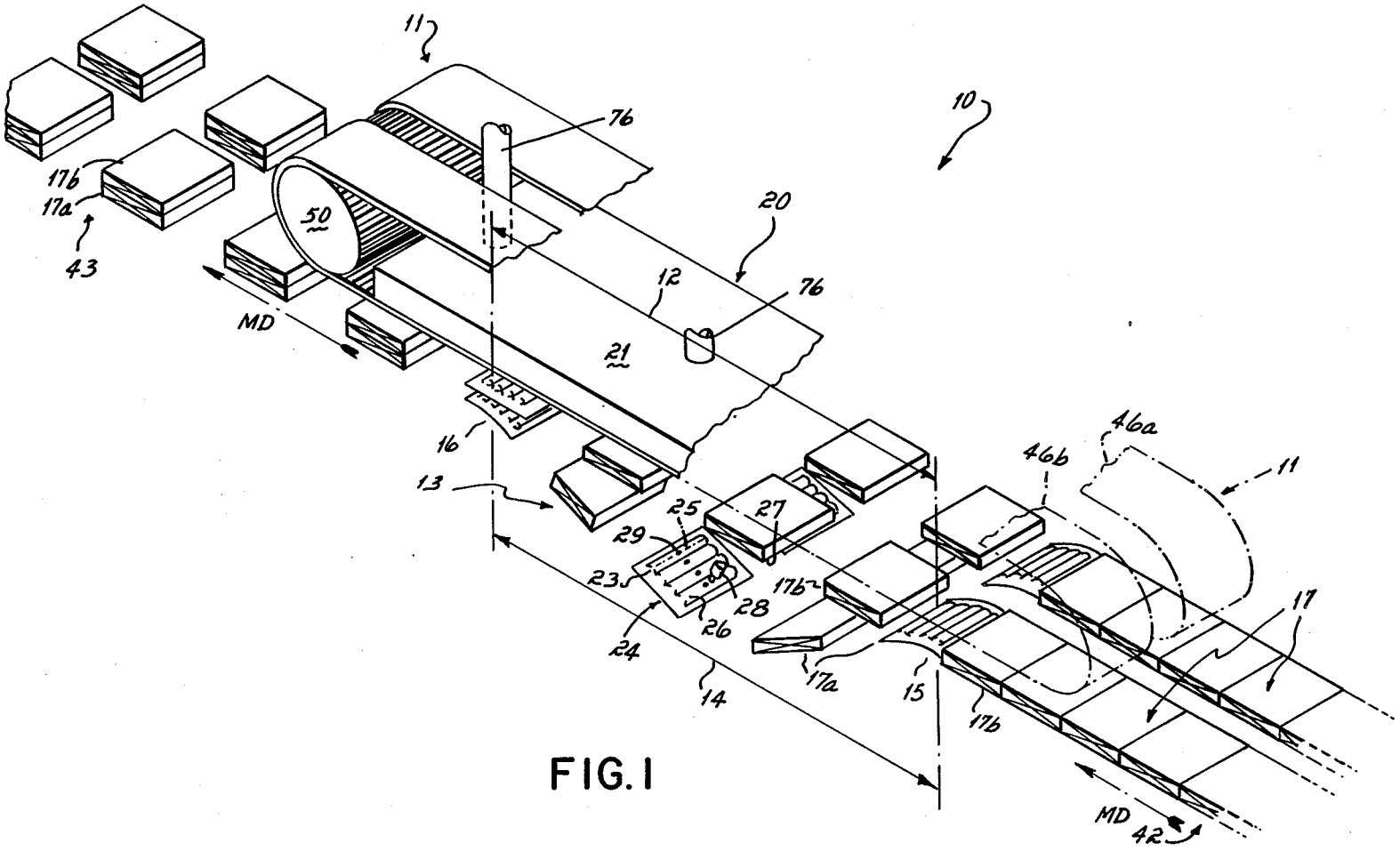
FIG. 1 is a top perspective view illustrating basic structure and function of a package collator machine in accord with the principles of this invention.
Figure 2:
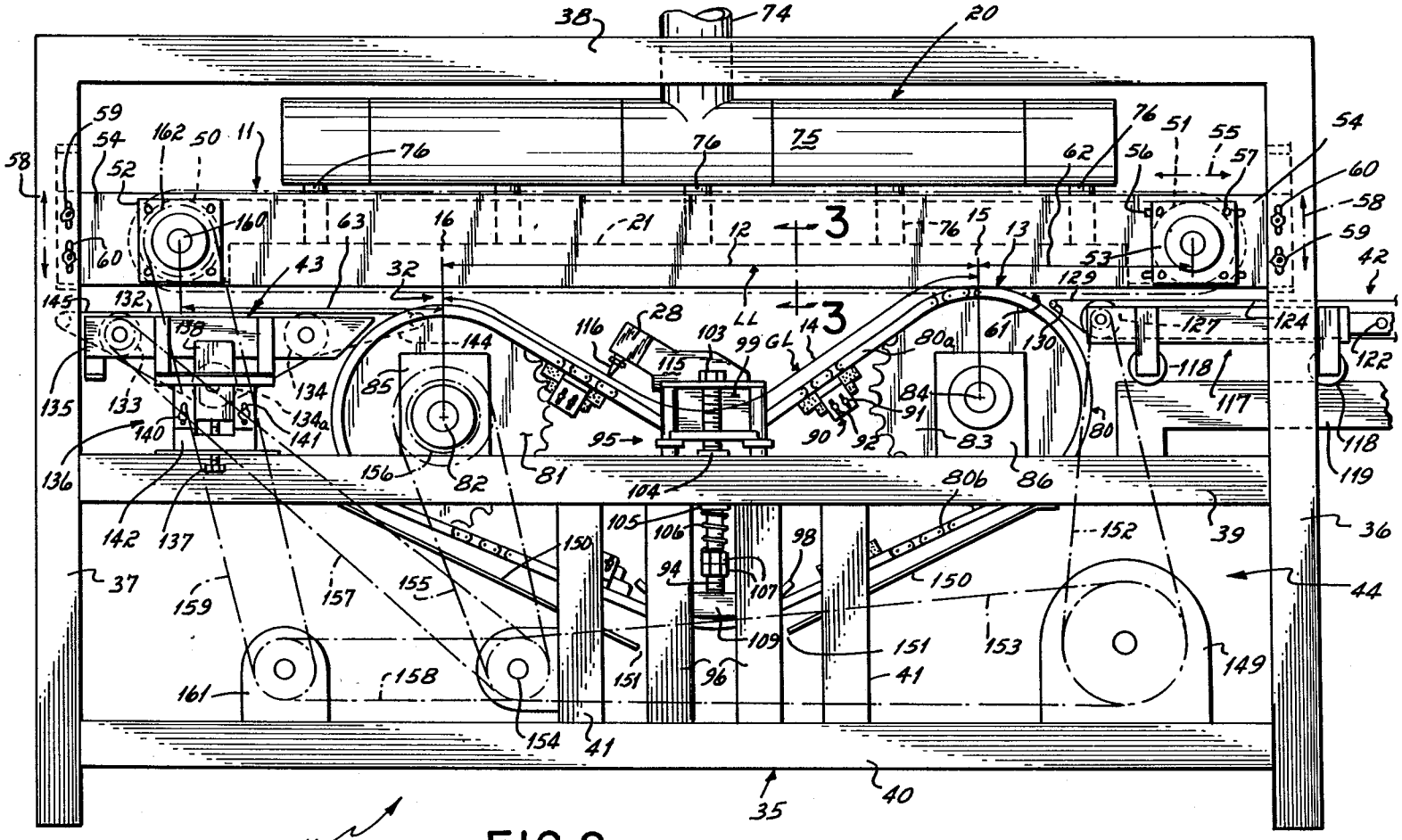
FIG. 2 is a side elevational view illustrating first and second conveyors of the package collator machine.

A package collator machine 10 in accord with the principles of this invention is illustrated in FIGS. 1 and 2. The package collator machine 10 basically includes a first or upper package conveyor 11 having a transfer section 12 of a lesser conveyor length, and a second or lower package conveyor 13 having a transfer section 14 of a greater conveyor length. These upper 11 and lower 13 package conveyors are juxtaposed to define a common machine direction MD and common entry 15 and exit 16 points. Each of the upper 11 and lower 13 conveyors are operable at the same line speed to move plural packages 17 through their transfer sections 12, 14 between the entry 15 and exit 16 points.

The upper package conveyor 11 is provided with a series of active package seats 18, and the lower package conveyor 13 is provided with a series of inactive package seats 19. The active package seats 18 are connected to a vacuum system 20 which includes a vacuum chamber 21. Accordingly, packages 17 are held by vacuum in the active package seats 18 as the upper conveyor 11 operates, and packages are held by gravity in the inactive package seats 19 as the lower conveyor 13 operates.

The machine is particularly adapted for use with packages 17 of sausages, e.g., hotdogs. These hotdog packages 17 are each comprised of a group of hotdogs 23, e.g., four hotdogs as shown. These hotdog 23 groups are each packaged in shrinkable plastic wrap 24 which conforms to the exposed hotdog surfaces. As a result, each package 17 is provided with a series of cylindrical hot dog 23 product where the longitudinal axes 25 of that product are parallel, the top 26 and bottom 27 primary faces of each package being curvilinear in nature because of the shrink wrapped package.

In use, multiple packages 17 are fed to the machine's entry point 15 oriented in-line one after the other as shown in FIG. 1. In this in-line infeed orientation, and as to each pair 17*a*, 17*b* of packages, the leading package 17*a* of each in-line pair is received by an in-active seat 19 of the lower conveyor 13, and the trailing package 17*b* of each in-line pair is received by an active seat 18 of the upper conveyor 11, see FIG. 5. Midway between the conveyor's entry 15 and exit 16 points a glue gun 28 deposits a spot 29 of glue on the curved upper face 26 portion defined by each hotdog 23 in the package 17 as to those packages on the lower conveyor 13.

The greater conveyor length GL (FIG. 2) of the lower conveyor 13 cooperates with the lesser conveyor length LL (FIG. 2) of the upper conveyor 11 so that the leading package 17*a* of each pair is delayed until the trailing package 17*b* of each pair catches up to it at the machine's exit point 16. When the trailing package 17*b* of each pair catches up to the leading package 17*a* at that exit point 16, and because glue dots 29 have been deposited on the lower package's top surface 26, the two packages 17*a*, 17*b* are glued together at that exit point in response to minimal pressure created by the nip 32 defined at that exit point by the upper 11 and lower 13 conveyors, see FIG. 6. Use of the glue dots 29 ensures that the upper 17*b* and lower 17*a* packages of each pair are retained in paired relation even though same present primary curved surfaces 26, 27 in face-to-face orientation so that the longitudinal axes 25 of both the upper package and the lower package are oriented in a plane 33 normal to a plane 34 that separates those two packages.

The package collator machine of this invention is particularly adapted to be interposed between a hotdog packaging machine 31 (FIG. 2A) and a package pair banding machine (not shown). The hotdog packaging machine takes individual hotdogs 23 from a feed supply and packages, e.g., four at a time, same in the individual packages 17 shown. The package banding machine (not shown) takes the paired 17*a*, 17*b* hotdog packages which exit from the package collator machine 10, and wraps a band (not shown) around that package for marketing purposes. The band (not shown) may be pre-printed with advertising or other consumer information.

DETAILED DESCRIPTION

The primary components of the package collator machine are carried on a machine frame 35. The machine frame 35 includes, when viewed as shown in FIG. 2, infeed end 36 and outfeed end 37 posts, and upper 38, intermediate 39, and lower 40 longitudinal braces. The intermediate 39 and lower 40 braces are held in spaced relation by vertical supports 41. This basic machine frame 35 supports the upper conveyor 11 and its related vacuum chamber 21, the lower conveyor 13, feed conveyor 42, and take-off conveyor 43, and the drive system 44.

Figure 5:
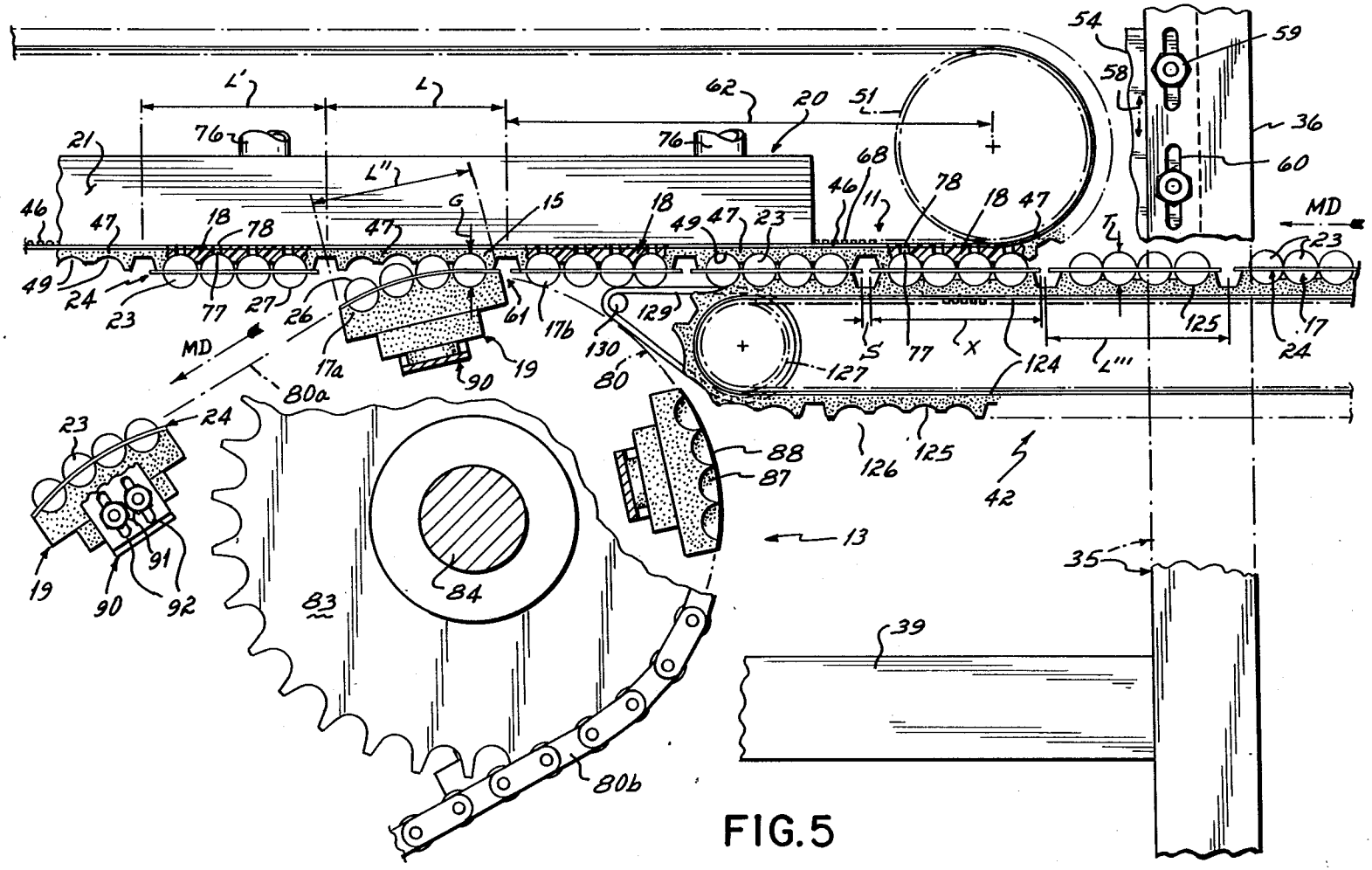
FIG. 5 is an enlarged view of a portion of FIG. 2 illustrating the entry point of the first and second conveyors.

The upper conveyor 11, as previously noted, includes a series of active seats 18 fixed to an air impervious belt 46, see FIG. 5. Each of these active seats 18 is separated one from the other by a spacer seat 47, the length L of the spacer seats and the length L, of the active seats all being identical one to the other. Each of these active 18 and spacer 47 seats is provided with a channeled surface to form a wave-like configuration adapted to receive the hotdogs 23 of each package 17 in seated relation. More specifically, each of the active 18 and spacer 47 seats is provided with a number of grooves 49 equal to the number of hotdogs 23 in each individual package 17, i.e., four in the embodiment shown, and these grooves are oriented normal to the machine direction MD of the upper conveyor 11.

The upper conveyor belt 46 is a timing belt trained around a driven gear 50 and an idler roller 51, those rollers being carried in bearings 52, 53 at opposite ends thereof, see FIG. 2. The upper conveyor bearings 52, 53 are fixed to a vertically adjustable frame member 54, the idler bearings 53 being adjustable in the direction shown in phantom arrow 55, as permitted by horizontal slot 56 and bolt 57 mounting, in order to take up slack in the upper conveyor belt 46 if required. The upper conveyor frame 54 itself is mounted to end posts 36, 37 of the machine frame 35. Note, particularly, the upper conveyor frame 54 is adjustable vertically, both up and down in the direction shown by phantom arrow 58, as permitted by mounting bolts 59 and vertical slots 60 in both end posts 36, 37 of the machine frame 35. This vertical adjustment of the upper conveyor 11 permits the gap G at the nip 61 of the upper 11 and lower 13 conveyors at the entry point 15, and the gap G' at the nip 32 of the upper conveyor and lower conveyor at the exit point 16, to be varied depending on the thickness T of the packages 17 being processed therethrough, see FIGS. 5 and 6.

The upper conveyor 11 includes a transfer section 12 that extends between the entry 15 and exit 16 points of the machine, an in-feed section 62 which extends between the conveyor's idler roller 51 and the start of its transfer section, and an out-feed section 63 which extends from the end of the conveyor's transfer section to the conveyor's drive gear 50. These in-feed 62, transfer 12, and out-feed 63 sections of the upper conveyor 11 also constitute the in-feed, transfer, and out-feed sections of the package collator machine 10. Further, the upper conveyor's transfer section 12 also corresponds with the lower conveyor's transfer section 13 since both the upper and lower conveyor's transfer sections commence at the machine's entry point 15 and terminate at the machine's exit point 16.

Figure 3:
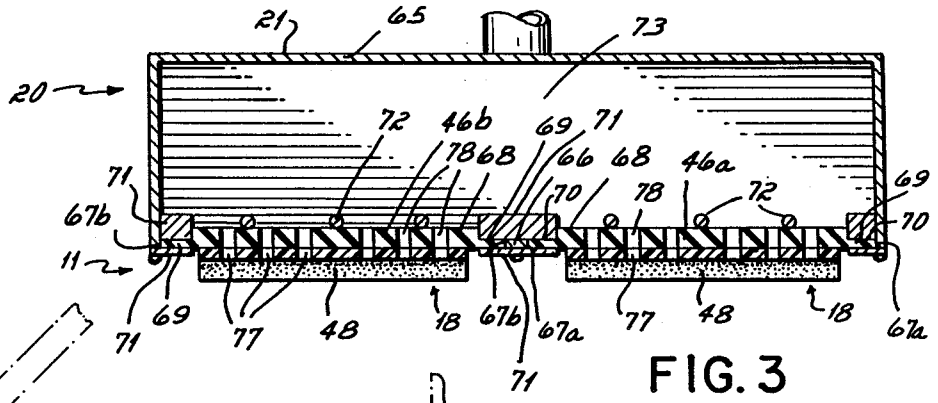
FIG. 3 is a cross-sectional view taken along line 3—3 of FIG. 2 illustrating the machine's vacuum chamber.
Figure 6:
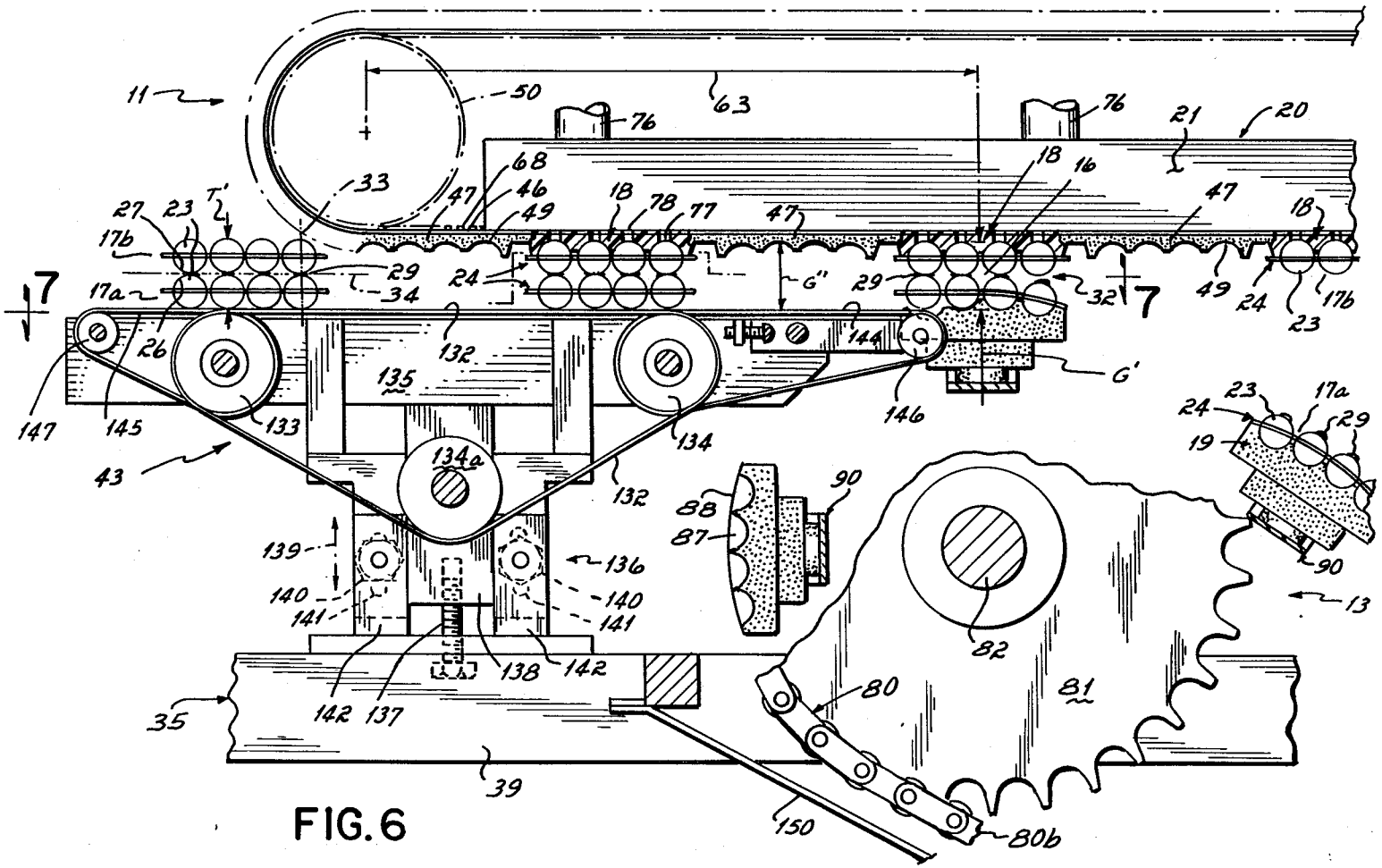
FIG. 6 is an enlarged view of a portion of FIG. 2 illustrating the exit point of the first and second conveyors.

The upper conveyor 11 cooperates with a vacuum system 20 connected with the active package seats 18, see FIGS. 1, 5 and 6. The vacuum system 20 cooperates with those packages 17*b* on the active package seats 18 to retain them in seated relation thereon as they move between the machine's entry 15 and exit 16 points during which travel, it will be apparent from FIG. 2, there is no support for same. The vacuum system 20, as shown in FIGS. 2, 3, 5 and 6, includes a vacuum chamber 21 that extends the length of the upper conveyor's transfer section 12, and extends partially into the upper conveyor's in-feed 62 and out-feed 63 sections. The vacuum chamber 21 is in the nature of an open or hollow box 65 which extends the width of the conveyor belt 46 so as to cooperate with the active package seats 18 carried by that conveyor belt. The floor 66 of the vacuum chamber 21, as shown in FIG. 3, is defined by two parallel longitudinal slots 67 that extend the length of the box 65, one slot 67*a*, 67*b* being adapted to serve each of the two conveyor belts 46*a*, 46*b*. The conveyor belt 46 is a timing belt where the teeth 68 are cut off each edge as at 69, thereby permitting the timing belt's edges to ride in and be guided by grooves 70 formed in the box floor 66 by plates 71 fixed to the box 65. A plurality of bars 72 oriented above each belt 46 extend the length of each slot 67, and are fixed to the box 65, to prevent the belt from being deflected into the box's interior 73 in response to the vacuum therein. A main vacuum duct 74 is connected with the vacuum box 65 through a vacuum manifold 75 and a series of manifold pipes 76, see FIG. 2. The main vacuum duct 74 is connected with vacuum equipment (not shown).

Each of the active seats 18 carried on the upper conveyor 11 is provided with a plurality of ports 77, at least one port communicating with each lateral groove 49 defined in that active seat, see FIGS. 3 and 5. These active seat ports 77 communicate with similar ports 78 in the conveyor belt 46 which, in turn, exposes the hotdog packages 17 on those seats to the vacuum in box 65. It is this vacuum, therefore, that makes the active seats 18 active, and that allows the packages 17 to be retained on those active seats when there is no physical support beneath those seats, see FIGS. 1, 2, 5 and 6. The spacer seats 47 on the upper conveyor 11, as shown particularly in FIG. 5, are not ported and, therefore, the vacuum from box 65 never acts on hotdog packages 17 in those spacer seats.

Figure 4:
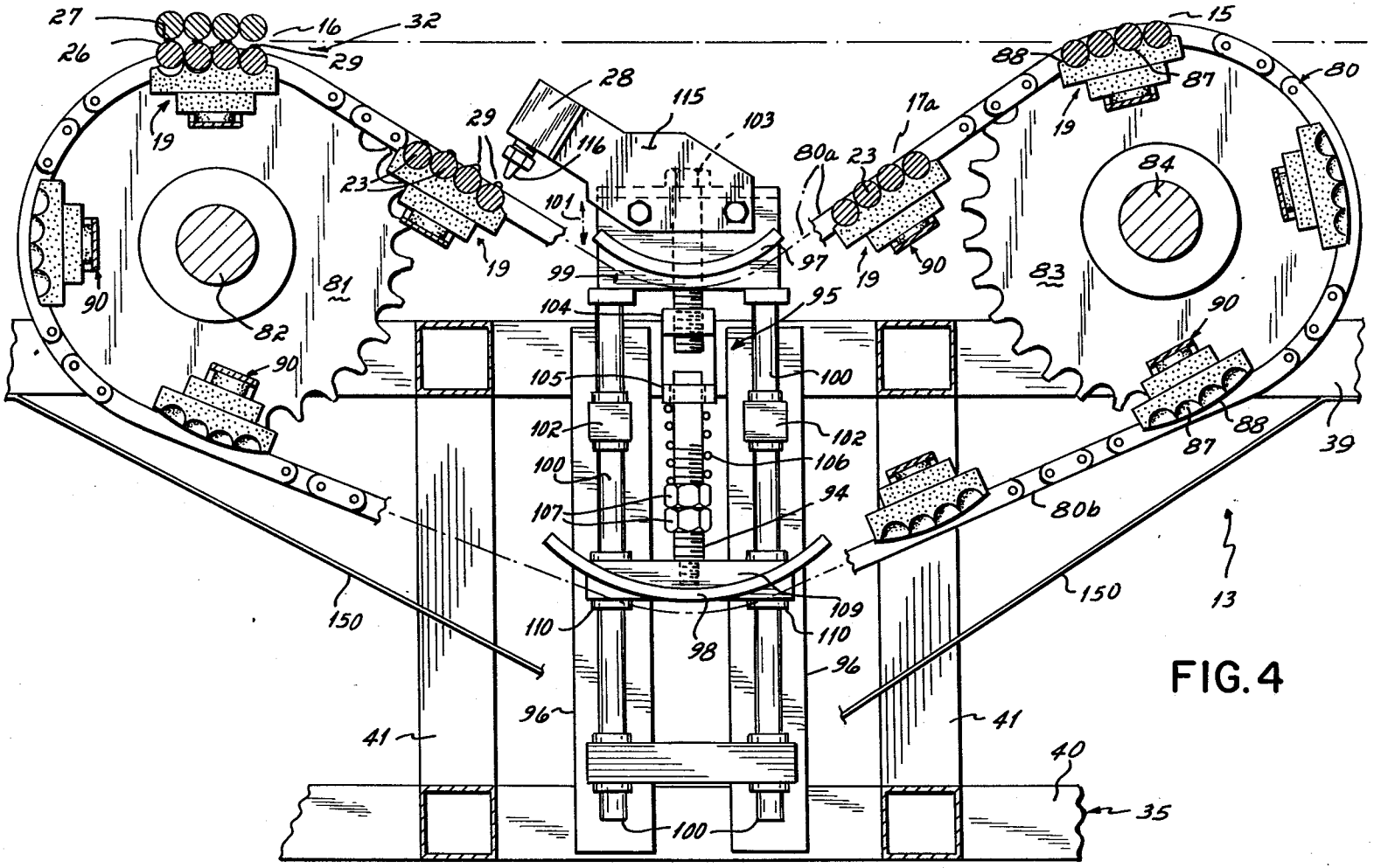
FIG. 4 is an enlarged view of a portion of FIG. 2 illustrating a conveyor of greater conveyor length.

The lower conveyor 13 is illustrated in FIG. 2 in combination with the upper conveyor, but is more particularly illustrated in FIG. 4. The lower conveyor 13 also includes a transfer section 14, but the conveyor travel length GL of the lower conveyor is greater than the conveyor travel length LL of the upper conveyor 11 within those conveyors' transfer sections 12, 14. The lower conveyor's travel length GL is greater than the upper conveyor's travel length LL by a distance at least equal to the length X (FIG. 5) of one package 17 such that the leading 17*a* and trailing 17*b* packages of each package pair are translated from in-line individual orientation as received at the entry point 15 into face-to-face paired orientation as out-fed at the exit point 16. More particularly, the lower conveyor's travel length GL, in the embodiment shown, is greater than the upper conveyor's travel length LL by a distance equal to the length X of each package plus the space S between seats 18, 47 carried by the upper conveyor 11. This additional length (equal to GL minus LL) for the lower conveyor's travel length is achieved by providing a generally V-shaped conveyor path for the lower conveyor 13 that cooperates with a linear conveyor path of the upper conveyor 11 when viewed in side elevation view, as shown in FIGS. 2 and 4.

The lower conveyor 13 carries a series of inactive package seats 19, those package seats being of the same L″ as the length L, L′ (FIG. 5) of the spacer 47 and active 18 package seats, respectively. Each inactive package seat 19 defines a series of slots or grooves 87 oriented normal to the machine direction MD of the lower conveyor 13 so as to seat the hotdogs 23 in the shrink wrapped packages 17. Note particularly, the seat face 88 of each inactive seat 19 which receives the hotdog package 17 is provided with a slight curvature of hump as viewed in side elevation relative to the linearity of the active 18 and spacer 47 seats. This slightly curved inactive seat surface 88 accommodates entry of hotdog packages 17 from the feed conveyor 42 on the inactive seats 19 of the lower conveyor 13 at the entry point 15 as shown in FIG. 5, and accommodates release of the lower package of 17*a* of each package pair from the lower conveyor's inactive seats on the take-off conveyor 43 as shown in FIG. 6.

Each of the inactive seats 19 is fixed to a cross bracket 90 carried by the opposed conveyor chains 80 of the lower conveyor 13. Each cross bracket 90 is adjustably connected by bolt 91 and slot 92 structure, see FIG. 5, to the chains 80 so that the inactive seats 19 can be adjusted vertically relative to the chain machine direction MD. This permits the nips 61, 32 defined by the lower conveyor's individual inactive seats 19 with individual active 18 and spacer 47 seats on the upper conveyor 11 to be varied as may be required at the entry point and exist point of the machine. The lower conveyor 13 is a chain 80 conveyor driven through drive sprocket 81 and drive shaft 82 at one end with idler sprocket 83 and idler shaft 84 at the other end, see FIG. 4. The drive shaft 82 and idler shaft 84 are connected to bearing plates 85, 86, respectively, fixed to intermediate cross brace 39 of the machine frame 35. Note also each inactive seat 19 is comprised of right 19*a*, left 19*b* hand and center 19*c* portions, as viewed in top view shown in FIG. 7, same defining a space or gap V therebetween. This gap V allows both the feed conveyor 42 and the take-off conveyor 43 to better cooperate with the inactive seats 19 at both the entry 15 and exit 16 points of the machine as described in greater detail below.

The travel length GL of the lower conveyor 13 between the entry 15 and exit 16 points of the machine 10 can be varied as required, too. A conveyor length adjuster mechanism 95, fixed to vertical frame posts 96 that extend between the lower 40 and intermediate 39 cross braces of the machine frame 35, is operatively connected with the transfer section 14 of the lower conveyor 13 to increase or decrease the conveyor length GL of that transfer section, see FIG. 4. This conveyor length adjustor mechanism 95 includes a curved head plate 97 and a curved foot plate 98. The curved head plate 97 is adapted to cooperate with the upper run 80*a* of the lower conveyor chain 80, and the curved foot plate 98 is adapted to cooperate with the chain's lower run 80*b*. The mechanism's head plate 97 is fixed to mounting plate 99 in turn fixed to slideable ways 100 that are vertically oriented. These slideable ways 100 are movable in the direction shown by phantom arrow 101, and are carried in sleeves 102 fixed to the machine frame ports 96. Adjustment bolt 103, rotatably carried in mounting plate 99, is threadably received in toe bracket 104 fixed to the intermediate machine frame member 39. Rotation of the adjustment bolt 103 moves the head plate 97 up or down relative to the lower conveyor's upper run 80*a*, thereby increasing or decreasing the conveyor length GL of that lower conveyor's transfer section 14. The foot plate 98 is fixed to shaft 94 slideably carried in sleeve 105 fixed to the machine frame 39, 35. A compression spring 106 is oriented between fixed sleeve 105 and spring tension adjustment nuts 107 on threaded portion of that slideable post 104. Accordingly, and as the head plate 97 is moved up or down as shown by phantom arrow 101 through use of adjustment bolt 103, the foot plate 98 also moves up or down to the extent necessary to maintain operable tension on the chain's lower run 806. The foot plate 98 is guided in its up-down motion by ways 100, the foot plate being fixed to mounting plate 109 in turn fixed to collars 110 slideably carried on the ways 100.

Figure 7:
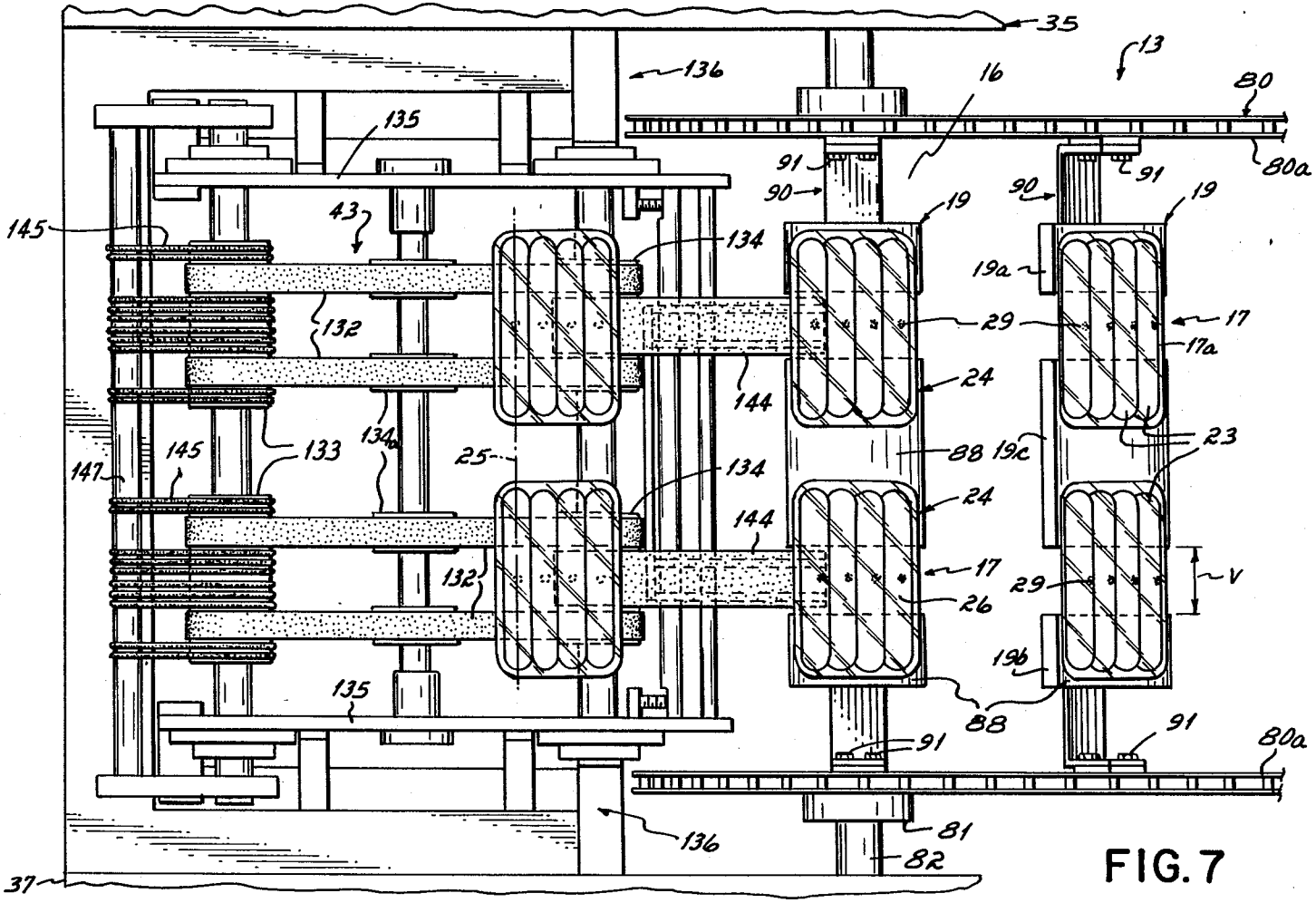
FIG. 7 is a top view illustrating the exit point of the first and second conveyors taken on line 7—7 of FIG. 6.

An adhesive device or glue gun 28 is fixed to the head plate's mounting plate 99 of the conveyor length adjustor mechanism 95 by a bracket 115, see FIG. 4. This adhesive device 28, which preferably is in the form of a commercially available hot melt adhesive gun, is adapted to deposit a dot 29 of adhesive intermediate the ends of each hotdog 23 of each package 17, as shown in FIGS. 1 and 7, as those hotdog packages are conveyed past the adhesive device's nozzle 116 as shown in FIG. 4. The adhesive device is preferably controlled by a control system (not shown) that operates in timed relation with the lower conveyor 13. Note particularly that the split seat structure 19*a*, 19*b*, 19*c* of each inactive seat 19 on the lower conveyor 13 ensures that if no package 17 is carried on an inactive seat, and the glue nozzle 116 discharges anyway, there will be no glue deposited on that inactive seat simply because the glue drops through gap or slot V which is parallel to the machine direction MD of the lower conveyor 13 because the glue nozzle 116 is oriented between the spaced apart inner ends of those split seat halves, i.e., within the gap V.

Figure 2A:
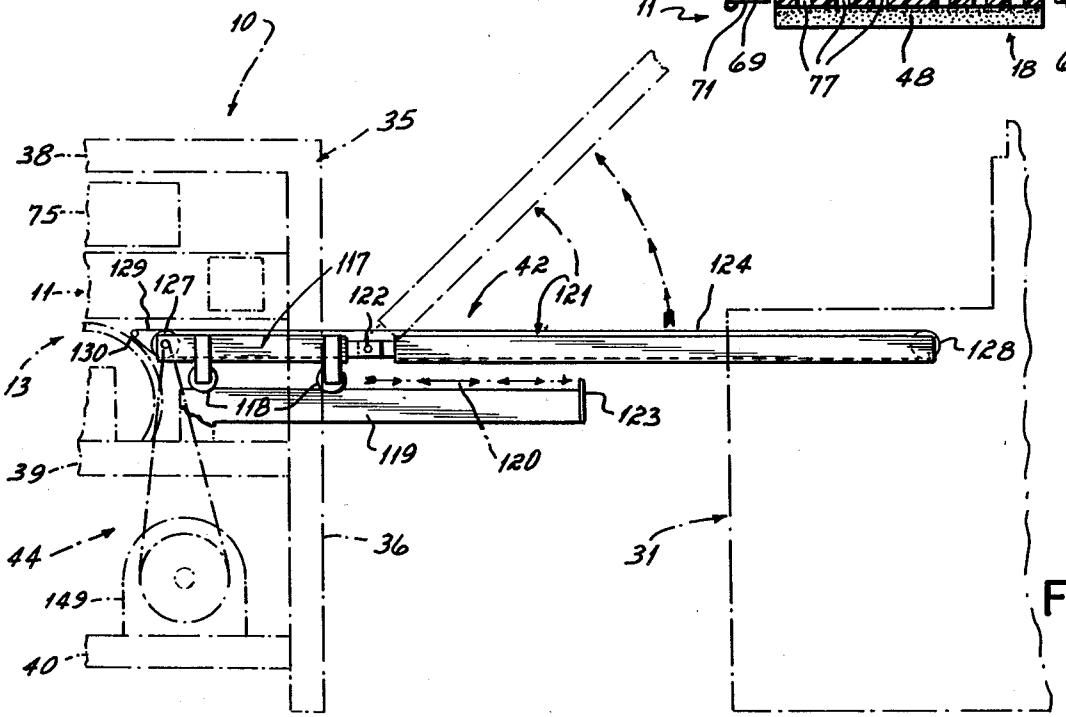
FIG. 2A is a side elevational view illustrating a feed conveyor of the package collator machine.

The in-feed conveyor 42 cooperates with the upper 11 and the lower 13 conveyors at the entry point 15 of the machine, as shown in FIGS. 2A and 5. The in-feed conveyor 42 is positioned between a hotdog packager machine 31 and the package collator machine 10 of this invention. The hotdog packager machine 31 takes individual hotdogs 23 as an in-feed, and packages same into shrink wrapped packages 27 where the upper 26 and lower 24 primary faces of those packages conforms generally to the tubular surfaces of the hotdogs, thereby providing each package with a curved upper surface and a curved lower surface.

The feed conveyor 42 is comprised of a head section 117 mounted on wheels 118 rotatably received on rails 119 fixed to end posts 36 of the machine frame 35. This allows the feed conveyor 42 to be moved in and out in the direction shown by phantom arrow 120, relative to the nip 61 at the entry point 15 of the machine 10 as required for installation servicing or the like. The feed conveyor 42 also includes an arm section 121 pivotally mounted as at 122 to the head section 117, that arm section being pivotably up out of the way as shown in phantom lines in FIG. 2A, if necessary, to withdraw the feed conveyor rearwardly from operative relation with the package collator machine 10 until the head section's wheels 118 abut stop 123 on rails 119.

The feed conveyor 42 includes a primary feed belt 124 with a series of feed package seats 125 fixed thereto, see FIG. 5. These feed package seats 125 are each of the same length L''' and face 126 configuration as the active and spacer seats 18 and 47 carried by the upper conveyor 11. The primary conveyor belt 124 of the feed conveyor 42 is a timing belt which is trained around drive gear 127 and idler roller 128. However, and in addition, a series of rubberband-like belts 129 are trained around grooves in drive gear 127 and nose idler roller 130 upstream of the feed conveyor's head section 117, those rubberband belts providing some degree of transition support, as shown in FIG. 5, as packages 17 are transferred from the feed conveyor 42 to the upper 11 and lower conveyors 13 at the nip 61 of those upper and lower conveyors. Note particularly that the feed conveyor's seats 125 are aligned with the upper conveyor's active seats 18 and spacer seats 47 in the in-feed section 62 of that upper conveyor 11 so as to transfer individualized and in-line four hotdog packages 17 into the upper conveyor's active 18 and spacer 47 seats.

The take-off conveyor 43 is operatively connected with the upper conveyor 11 and the lower conveyor 13 at the exit point 16 of the package collator machine 10 as shown particularly in FIGS. 2 and 6. The take-off conveyor 43 simply provides a conveyor belt 132 with no special seats thereon, that belt being trained around driver roller 133 and idler roller 134 and tension rollers 134. The driver roller 133 and idler roller 134 are connected by bearings to take-off conveyor frame 135. The take-off conveyor frame 135 is fixed to the machine frame 35 by a take-off conveyor bracket 136. An adjustment bolt 137 threadedly received in plate 138 of the take-off conveyor frame 135 permits the tension roller 134*a* of the take-off conveyor to be adjusted up or down. A pair of bolts 140 and slots 141 in machine bracket 142 and the take-off conveyor bracket 136 permits the conveyor 43 to be adjusted vertically in the direction of arrow 139 and locks the take-off conveyor frame 135 and, therefor, the take-off conveyor 43, into the desired vertical position. This take-off conveyor height adjustment mechanism 140, 141 allows the gap G'' between the upper conveyor 11 and the take-off conveyor 43 to be adjusted as required depending on the thickness T' of each stacked product package pair 17*a*, 17*b* passing therebetween.

The take-off conveyor 43 also includes a series of belts 144 trained around the idler roller 134, and a series of rubberband-like belts 145 trained around the driver roller 133, same also being trained around their own individual idler rollers 146, 147, respectively, carried by the take-off conveyor frame 135. The leading take-off belts 144 are adapted to reach into the gap V of lower conveyor's inactive seats 19 as shown particularly in FIGS. 6 and 7 in order to ensure even transition for the paired packages from the machine's exit point 16 onto the take-off conveyor 43. The take-off conveyor 43 picks off each face-to-face package pair 17*a*, 17*b* from the lower conveyor's inactive seats 19, and directs same downsteam for further processing. These further steps may include, for example, the banding of each package pair with a paper board or plastic band that includes source and/or advertising information about the hotdogs.

A funnel-like structure 150 is positioned beneath the lower conveyor 13, see FIG. 2. The funnel 150 functions to catch any hotdog package 17 that falls from the active seats 18 of the upper conveyor if the vacuum fails to hold it onto that active seat. The funnel 150 directs the hotdog packages 17 that fall off to a discharge port 151 where same can be recycled if desired.

The package collator machine 10 includes a common drive unit 44, as shown in FIG. 2, for the feed conveyor 42, upper conveyor 11, lower conveyor 13 and take-off conveyor 43. Indeed, it is the ability of the machine 10 to function with a single drive unit 44 that constitutes one of its primary advantages because this allows all conveyors 11, 13, 42, 43 to operate at the same line speed. This, in turn, allows for a relatively simplified drive system to be used with the package collator machine. More particularly, the drive system includes a single motor reducer drive unit 149 fixed to lower brace 40 of the machine frame 35. A first drive chain 152 from this drive unit 149 is connected with drive gear 127 of the feed conveyor 42. A second drive chain 153 from drive unit 149 is connected with a drive transfer unit 154 fixed to the machine frame member 41. The transfer unit 154 is connected via a third chain and sprocket drive 155 to the drive sprocket 81 of the lower conveyor 13. The lower conveyor's drive shaft 82 is also provided with a static synchronizer 156 which allows the conveyor chain 80 and, therefor, the inactive seats 19, to be adjusted relative to the vacuum conveyor belt 46, and, therefor, the active seats 18, when both the upper conveyor 11 and the lower conveyor 13 are stationery. The drive transfer unit 154 also is directly connected via fourth drive chain 157 with the take-off conveyor 43. The transfer unit 154 is further connected to upper conveyor drive gear 50 via fifth 158 and sixth 159 drive chains which drive shaft 160 of gear 50. A direction reverser unit 161, fixed to machine frame 35, is interposed between the fifth 158 and sixth 159 drive chains to maintain the machine direction MD of the upper conveyor belt 46. That is, the lower run of upper conveyor belt 46 must have the same MD as the upper run of conveyors 42, 13 and 43.

As noted above, the input conveyor 42, and the overhead vacuum conveyor 11 are comprised of timing belts and gears and the lower conveyor is a chain and sprocket conveyor. This permits a synchronization to be maintained during the operation of the machine. However, and if during the course of operation, the packages should become out of synchronization, a dynamic synchronizer 162 is mounted on the upper conveyor's drive shaft 160. This dynamic synchronizer provides for an adjustment of the upper conveyor belt 46 and, therefor, the active 18 and spacer 47 seats on that conveyor belt relative to the inactive seats 19 on the lower conveyor chains 80 when the conveyors 11, 13 are running, i.e., when the conveyors are in operation. The drive unit 149, drive transfer unit 154, direction reverser unit 161, static synchronizer 156, dynamic synchronizer 162 are all structural components commercially available and form no part of this invention individually.

OPERATION

Individual packages 17 are fed into the package collator machine 10 on the feed conveyor 42. Each of these individual packages 17, which is comprised of four separate hotdogs 23 as shown, is positioned on a feed package seat 125 carried on the feed conveyor 42. These feed package seats 125 are each of a length L''' identical to the length L and L' of the spacer seats 47 and active seats 18, respectively, positioned end to end on the upper conveyor 11. As the individual in-line packages 17 are conveyed in the machine direction MD of the feed conveyor 42, see FIG. 5, same are introduced into the in-feed section 62 of the upper conveyor 11 where the individual in-line packages on the feed conveyor are seated, alternately, in active 18 seats and spacer 47 seats carried by the upper conveyor 11.

When the individual in-line packages 17 have been transferred from the feed conveyors' feed seats 125 to the upper conveyor's active 18 and spacer 47 seats, same pass through the inlet nip 61 of the upper 11 and lower 13 conveyors through entry point 15 of the machine 10. It is at the entry point 15 of the machine that alternate in-line packages **17*b* are maintained in operational combination with the upper conveyor's active seats 18 because of the vacuum system 20 which provides vacuum ports 77, 78 through belt 46 and seats 18. It is also at this entry point 15 of the machine's upper 11 and lower 13 conveyors that the packages 17*a* initially positioned in the upper conveyor's spacer seats 47 are transferred to the lower conveyor's inactive seats 19, all as shown in FIG. 5. Note particularly that at the entry point 15 of the upper 11 and lower 13** conveyors the upper conveyor's seats are spaced a distance one from the other essentially equal to the thickness T of each package.

The objective of the package collator machine 10 is to translate each pair **17*a*, 17*b* of in-line packages from the infeed in-line orientation into the outfeed face-to-face orientation. Such is achieved, even though the line speeds of both the upper 11 and lower 13 conveyors are the same, by virtue of the transfer length GL of the lower conveyor 13 being greater than the transfer length LL of the upper conveyor 11. In other words, as a leading package 17*a* of each package pair is seated in an inactive seat 19 of the lower conveyor 13, a trailing package 17*b* of that package pair will be retained in seated relation on the active seat 18 of the upper conveyor 11, see FIG. 5. Since the leading package 17*a* of that package pair has to travel through a greater transfer length GL than the transfer length LL for the trailing package 17*b* of that package pair, and since that greater length GL is essentially equal to the travel length LL for the trailing package 17*b* plus the length X of the package 17*b* plus the space S between the two packages 17*a*, 17*b*, then when those leading and trailing packages are brought together once again at the exit 16 of the machine 10, i.e., at the exit nip 32 of the two conveyors 11, 13, the two packages 17*a*, 17*b* will be oriented one on top the other in primary face-to-face relation. As shown in FIG. 6, this face-to-face orientation is such that a vertical plane 33 which includes the longitudinal axis of lower and upper hotdogs 23 in the leading 17*a* and trailing 17*b* packages of each pair is oriented normal to the longitudinal phantom plane 34** that separates those two packages.

As the leading package **17*a* of each package pair travels along the lower conveyor 13, it passes under nozzle 116 of glue gun 28 which deposits a dot 29 of glue on the upper curved primary surface 26 of each of the four hotdogs in that package as shown particularly in FIGS. 1 and 7. When this leading package 17*a* of each package pair is thereafter mated up at the exit nip 32 with the trailing package 17*b*, those two packages are thereby adhered together by virtue of the pressure exerted on same at the exit nip of the upper 11 and lower 13 conveyors, and maintained under that pressure through the outfeed section 63 by the upper conveyor 11 and take-off conveyor 43. Note that the gap G' between the upper conveyor's active seats 18 and the lower conveyor's inactive seats 19 is twice the thickness T of each package. And this gap G' is controlled so that a minimum degree of pressure is exerted between the lower 17*a* and upper 17*b* packages at the exist point 16 to ensure the upper package's bottom face 27 is adhered to the lower package's upper face 26. It is important where the abutting upper face 26 of the lower package 17*a* and lower face 27 of the upper package 17*b* are curved, such as with the hotdog packages, that the pressure exerted at the exit point 16 in combination with the glue dots 29 be such that the packages are adhered one to the other in the aforementioned geometry where the plane 33 that includes the longitudinal axes 25 of adjacent upper and lower hotdogs 23 in the lower 17***a* and upper 17*b* packages is oriented normal to the longitudinal phantom separator plane 34 between those two packages in order that each pair of packages, when it is free of the upper conveyor 13, retains the as-oriented dual package configuration as shown in FIG. 6. Without the glue dots 29, and particularly where the packages 17 present curved surface faces 26, 27 one to the other at the separator plane 34, those packages would not retain their exact rectangular cross-sectional orientation, i.e., those packages would more likely fall into a shingled or parallelogram cross-section orientation where a plane that includes the longitudinal axes of upper and lower hotdogs would be at an angle relative to the phantom separator plane. This is undesired because it may adversely affect the banding operation or further packaging operations downsteam.

What is claimed is:

1. A package collator machine comprising a first package conveyor having a transfer section of a lesser conveyor length, a second package conveyor having a transfer section of a greater conveyor length, said first and second package conveyors being juxtaposed to define common entry and exit points, each of said first and second conveyors being operable at the same line speeds to move plural packages through said transfer sections between said entry and exit points, a feed conveyor located to supply the entry point of said first and second conveyors with multiple packages oriented in-line one after the other, a series of active package seats fixed to one of said first and second conveyors, a series of inactive package seats fixed to the other of said first and second conveyors, a leading package of each successive in-line package pair being received in a seat fixed to one of said first and second conveyors and a trailing package of that same package pair being received in a seat fixed to the other of said first and second conveyors, and a vacuum system connected with said active package seats, said vacuum system cooperating with those packages in seated relation on said active package seats to retain said packages thereon as said active seated packages move between said entry and exit points, the difference between said lesser and greater conveyor lengths being at least equal to the length of said trailing package, and being such that said leading and trailing packages of each package pair are translated from in-line individualized orientation as received at said entry point of said first and second conveyors into face-to-face paired orientation at said exit point of said first and second conveyors.

2. A package collator machine as set forth in claim 1, said packages of each package pair being of the same package length.

3. A package collator machine as set forth in claim 2, the leading edges of each package pair being aligned one with the other, and the trailing edges of each package pair being aligned one with the other, when said packages of each package pair are in face-to-face paired relation.

4. A package collator machine as set forth in claim 2, each package of each package pair having at least one primary curved surface, said primary curved surfaces being located one against the other in face-to-face orientation.

5. A package collator machine as set forth in claim 4, the primary face of each package having plural curved surfaces, said curved surfaces being defined by a cylindrical product packaged therein.

6. A package collator machine as set forth in claim 5, said cylindrical product being oriented normal to the machine direction of said first and second conveyors.

7. A package collator machine as set forth in claim 1, said machine comprising an adhesive device connected to said machine, said adhesive device being adapted to deposit adhesive on at least one package of each package pair so that each package pair is retained in face-to-face orientation after passing through said exit point.

8. A package collator machine as set forth in claim 1, one of said first and second conveyors defining a linear conveyor path and the other of said first and second conveyors defining a non-linear conveyor path, said linear and non-linear conveyor paths being common at said entry and exit points, but said non-linear conveyor path being spaced from said linear conveyor path between said entry and exit points.

9. A package collator machine as set forth in claim 8, said non-linear conveyor path being of a generally V-shaped configuration as viewed in side view.

10. A package collator machine as set forth in claim 8, one of said linear and non-linear conveyor paths being oriented above the other of said linear and non-linear conveyor paths.

11. A package collator machine as set forth in claim 10, said active package seats being fixed to that one of said first and second conveyors with the upper conveyor path.

12. A package collator machine as set forth in claim 1, said machine comprising a series of spacer package seats fixed to that one of said first and second conveyors to which said active package seats are fixed, a spacer package seat being positioned between every two active package seats, said spacer package seats not being connected to said vacuum system.

13. A package collator machine as set forth in claim 12, that one of said first and second conveyors with active package seats comprising an in-feed section located upstream of said entry point, said spacer package seats while within said in-feed section cooperating with said feed conveyor in transferring said in-line individual packages from said feed conveyor in alternate fashion first to one of said first and second conveyors and then to the other of said first and second conveyors.

14. A package collator machine as set forth in claim 13, said machine comprising a series of feed package seats fixed to said feed conveyor, said feed package seats being adapted to cooperate with said active package seats and said spacer package seats as said in-line individualized packages traverse said in-feed section in order to transfer one package of each in-line package pair from said feed conveyor to an active package seat and the other package of each package pair from said feed conveyor to an inactive package seat.

15. A package collator machine as set forth in claim 1, said machine comprising a takeoff conveyor located to withdraw each pair of face-to-face oriented packages from said exit point of said first and second conveyors.

16. A package collator machine as set forth in claim 12, said machine comprising a takeoff conveyor located to withdraw each pair of face-to-face oriented packages from said exit point of said first and second conveyors.

17. A package collator machine a set forth in claim 16, that one of said first and second conveyors with active package seats comprising an outfeed section located downstream of said exit point, said spacer package seats while within said outfeed section cooperating with said takeoff conveyor in removing each pair of said face-to-face oriented packages from said exit point.

18. A package collator machine as set forth in claim 1, said packages of each package pair being of the same package thickness.

19. A package collator machine as set forth in claim 18, the spacing between said active and inactive seats at said entry point being substantially equal to the thickness of a single package, and the spacing between said active and inactive seats at said exit points being substantially equal to twice the thickness of a single package.

20. A package collator machine as set forth in claim 1, at least one of said active and inactive seats each comprising two sections spaced one from the other, said two sections thereby exposing that face of each package seated thereon to said feed conveyor for aid in transferring those packages from said feed conveyor to said sectioned seat.

21. A package collator machine as set forth in claim 1, said machine comprising a conveyor length adjustor mechanism connected with said transfer section of one of said first and second conveyors, said mechanism being adapted to increase and decrease the conveyor length of that transfer section to which it is connected.

22. A package collator machine as set forth in claim 21, said conveyor length adjustor mechanism being connected to that transfer section of said greater length conveyor.

23. A package collator machine as set forth in claim 22, said machine comprising a slack take-up mechanism connected with said transfer section of said greater length conveyor.

24. A package collator machine as set forth in claim 1, said vacuum system comprising a vacuum chamber located to cooperate with that one of said first and second conveyors that carries said active package seats, said vacuum chamber extending the length of said transfer section, said vacuum chamber having an open floor section that also extends the length of said transfer section, and an air impervious conveyor belt to which said active seats are fixed, said active seats as well as that belt area to which said active seats are fixed being ported so as to expose packages seated thereon to a vacuum through said vacuum chamber's slotted floor.

25. A package collator machine as set forth in claim 24, said air impervious conveyor belt being carried in tracks provided on said vacuum chamber floor.

26. A package collator machine as set forth in claim 1, said machine comprising a single drive motor drive unit connected to all of said first, second and feed conveyors.

27. A package collator machine as set forth in claim 26, said machine comprising a first synchronizer connected between said first conveyor and said motor drive unit, and a second synchronizer connected between said second conveyor and said motor drive unit, said first and second synchronizers cooperating to allow alignment adjustment of said active and inactive seats one with the other.

28. A package collator machine as set forth in claim 1, said machine comprising a nip adjustor mechanism connected with one of said active and inactive package seats, said nip adjustor mechanism being operable to adjust the nip between said active and inactive seats at said exit point of said first and second conveyors.

* * * * *